US008202122B2

(12) United States Patent
Wu

(10) Patent No.: US 8,202,122 B2
(45) Date of Patent: Jun. 19, 2012

(54) CABLE CONNECTOR ASSEMBLY WITH IMPROVED CONDUCTIVE SHELL

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/015,319

(22) Filed: Jan. 27, 2011

(65) Prior Publication Data

US 2011/0195590 A1 Aug. 11, 2011

(51) Int. Cl.
*H01R 13/648* (2006.01)

(52) U.S. Cl. ..... 439/607.47; 439/76.1; 439/352

(58) Field of Classification Search ..... 439/607.47, 439/607.46, 607.41, 352, 76.1
See application file for complete search history.

(56) References Cited

U.S. PATENT DOCUMENTS

| | | | | |
|---|---|---|---|---|
| 7,147,502 | B1 * | 12/2006 | Wu | 439/352 |
| 7,261,582 | B2 * | 8/2007 | Wu | 439/352 |
| 7,476,117 | B1 * | 1/2009 | Chen et al. | 439/352 |
| 7,651,341 | B2 | 1/2010 | Wu | |
| 7,690,939 | B2 * | 4/2010 | Wu | 439/352 |
| 7,771,225 | B1 * | 8/2010 | Wu | 439/352 |
| 2008/0032541 | A1 * | 2/2008 | Reed et al. | 439/352 |

* cited by examiner

*Primary Examiner* — Gary F. Paumen
(74) *Attorney, Agent, or Firm* — Wei Te Chung; Andrew C. Cheng; Ming Chieh Chang

(57) ABSTRACT

A cable connector assembly includes a conductive housing, a pair of PCBs, two cables and a metal shell assembled to the housing. The housing defines a receiving cavity. The PCBs are received in the receiving cavity at different levels. The two cables are located at a rear wall of the housing and electrically connect to the PCBs. The metal shell is assembled to the housing and includes a frame portion, and an extension portion extending forwardly from an upper wall of the frame portion. The frame portion encloses a rear portion of the housing and the extension portion has a pair of first position holes. The housing has a pair of second position holes are aligned with first position holes respectively. Two bolts penetrate through the first position holes and are locked in the second position holes respectively.

9 Claims, 6 Drawing Sheets

CABLE CONNECTOR ASSEMBLY WITH IMPROVED CONDUCTIVE SHELL

BACKGROUND OF THE INVENTION

1. Field of the Invention

The present invention relates generally to a cable connector assembly, and more particularly to a cable connector assembly with improved conductive shell.

2. Description of Related Art

U.S. Pat. No. 7,651,341 issued to Jerry Wu on Jan. 26, 2010 discloses a cable connector assembly. The cable connector assembly comprises a housing enclosing a receiving cavity, a pair of first and second printed circuit boards, at least two cables, and a conductive shell assembled to the housing. The receiving cavity includes a hollow portion and a mating port disposed in front of the hollow portion. Said pair of first and second printed circuit boards have mating interfaces extending into the mating port and mounting portions located within the hollow portion. The at least two cables are arranged at different levels at a rear wall of the housing and electrically connecting to the mounting portions of the first and second printed circuit boards. The conductive shell comprises a body portion, a pair of lateral walls extending downwardly from opposite sides of the body portion, a rear wall extending downwardly from a rear side of the body portion and a spring member formed at a front edge of the body portion. Two pairs of bolts are assembled to the cover and the base to combine them together with the conductive shell. Therefore, it is difficult to assemble the cover and the base together.

Hence, it is desired to provide a cable connector assembly to overcome the problems mentioned above.

BRIEF SUMMARY OF THE INVENTION

A cable connector assembly comprises a conductive housing, a pair of first and second PCBs, at least two cables and a metal shell assembled to the housing. The conductive housing defines a receiving cavity including a hollow portion and a mating port located in front of the hollow portion. The pair of first and second PCBs are received in the receiving cavity at different levels and have mating interfaces extending into the mating port and mounting portions located within the hollow portion. The at least two cables are located at a rear wall of the conductive housing and electrically connect to the mounting portions of the first and second PCBs, respectively. The metal shell is assembled to the housing and comprises a frame portion, and an extension portion extending forwardly from an upper wall of the frame portion. The frame portion encloses a rear portion of the conductive housing and the extension portion has a pair of first position holes. The conductive housing has a pair of second position holes are aligned with first position holes respectively. Two bolts penetrate through the first position holes and are locked in the second position holes respectively.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
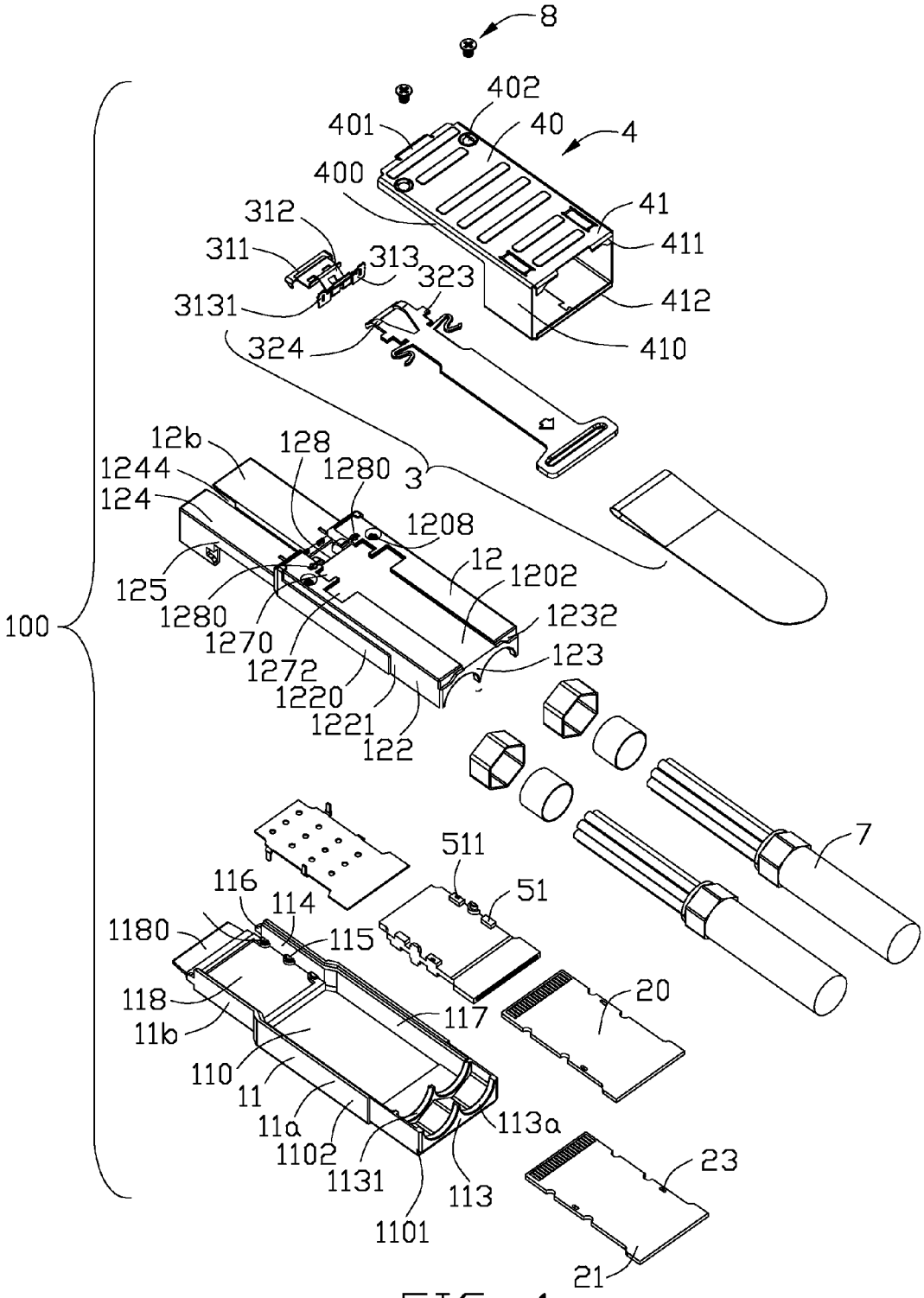
FIG. 1 is an exploded, perspective view of a cable connector assembly according to the present invention.

Reference will be made to the drawing figures to describe the present invention in detail, wherein depicted elements are not necessarily shown to scale and wherein like of similar elements are designated by same or similar reference numeral through the several views and same or similar terminology.

Referring to FIGS. 1-6, a cable connector assembly 100 in accordance with the present invention comprises a shell housing 1 defining a receiving cavity 15, a pair of printed circuit boards (PCBs) 2 located in the housing 1 at different levels, two cables 7 electrically connecting with the PCBs 2 at a rear end of the shell housing, and a latch mechanism 3 assembled to the housing 1 at the rear end of the housing 1. The receiving cavity 15 includes a hollow portion and a mating port located in front of the hollow portion. The PCBs 2 are received in the hollow portion and extend into the mating port of the receiving cavity 15. A description of said elements will be given hereinafter.

Figure 2:
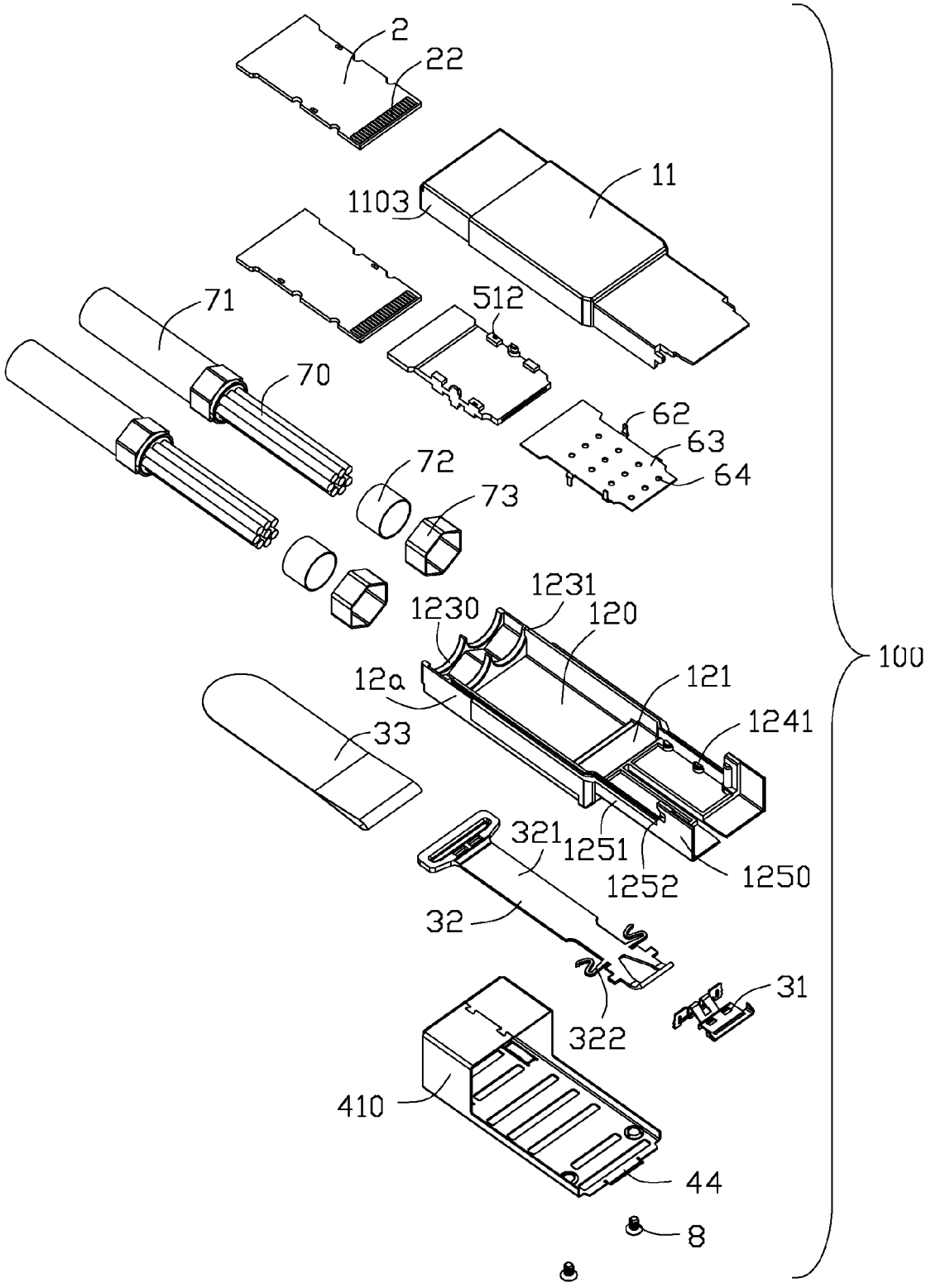
FIG. 2 is a view similar to FIG. 1, but viewed from a different aspect.
Figure 3:
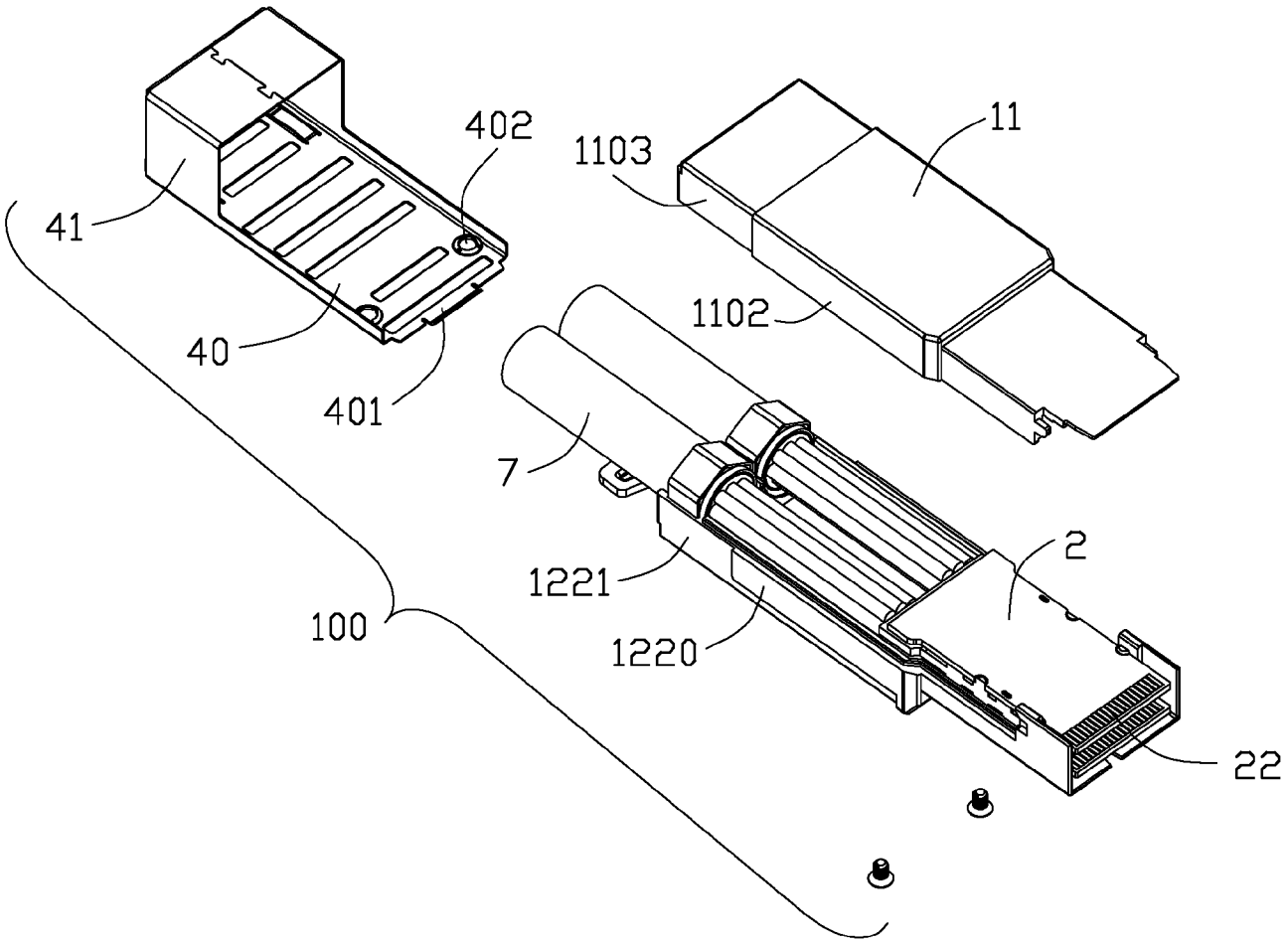
FIG. 3 is a part, assembled view of the cable connector assembly shown in FIG. 1.
Figure 4:
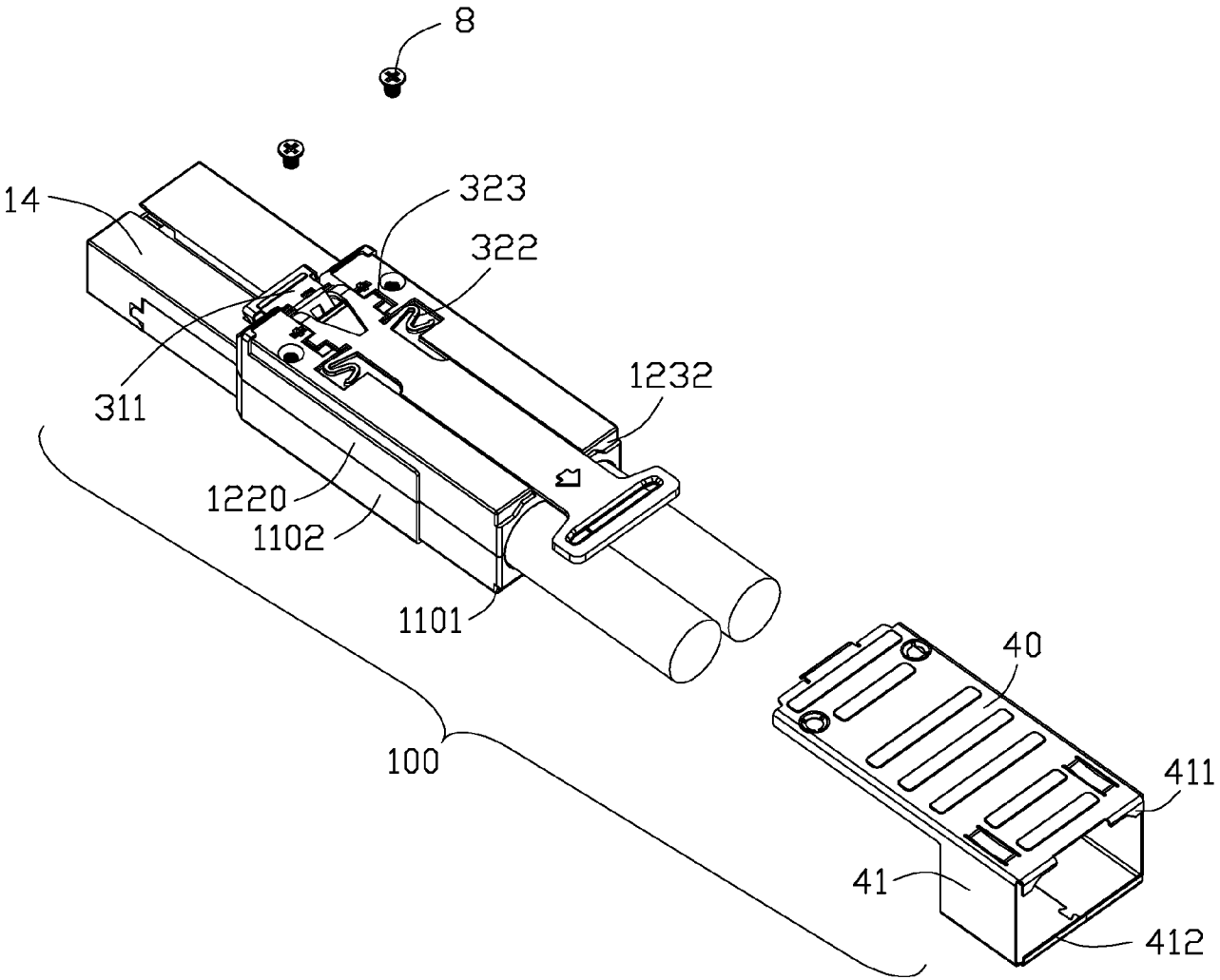
FIG. 4 is another part, assembled view of the cable connector assembly shown in FIG. 1.
Figure 5:
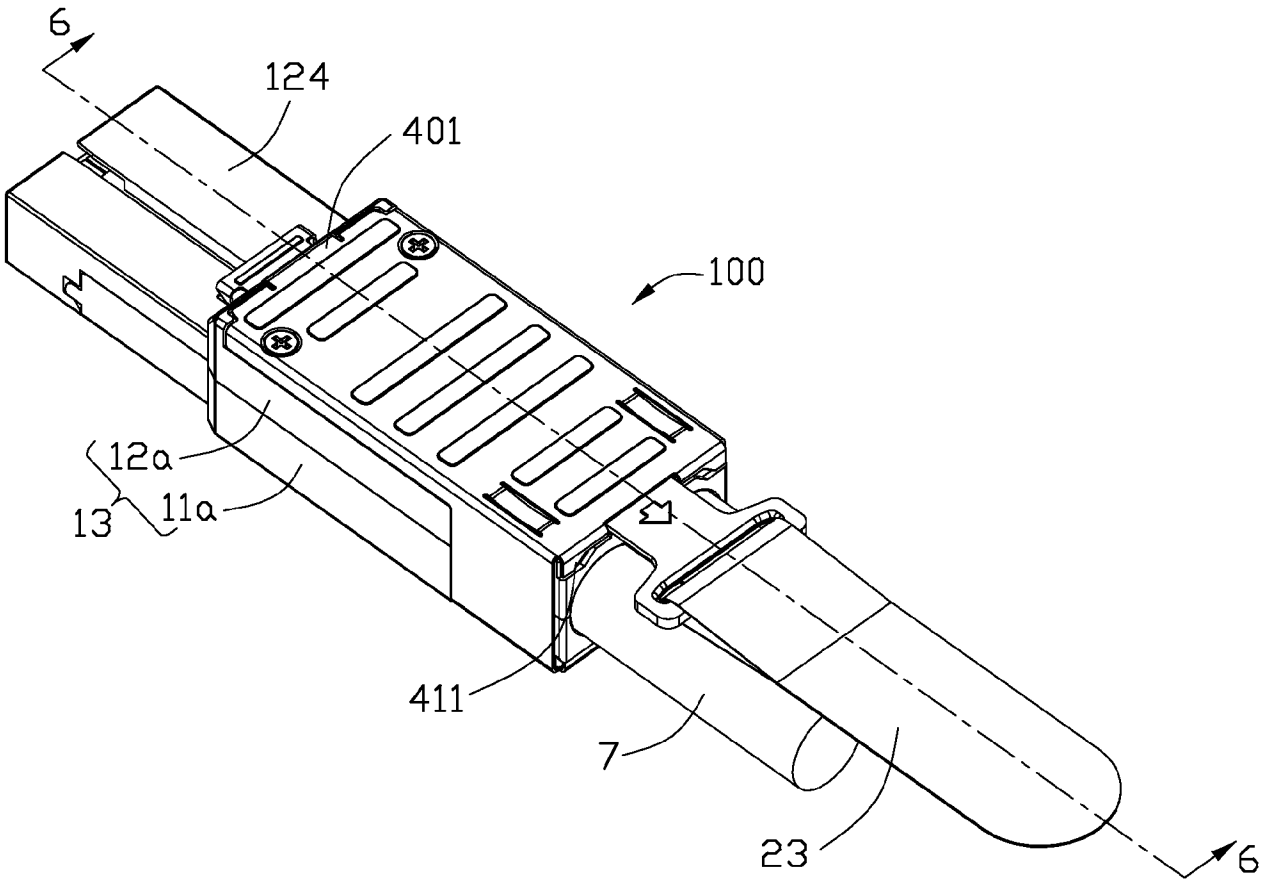
FIG. 5 is an assembled view of the cable connector assembly shown in FIG. 1.
Figure 6:
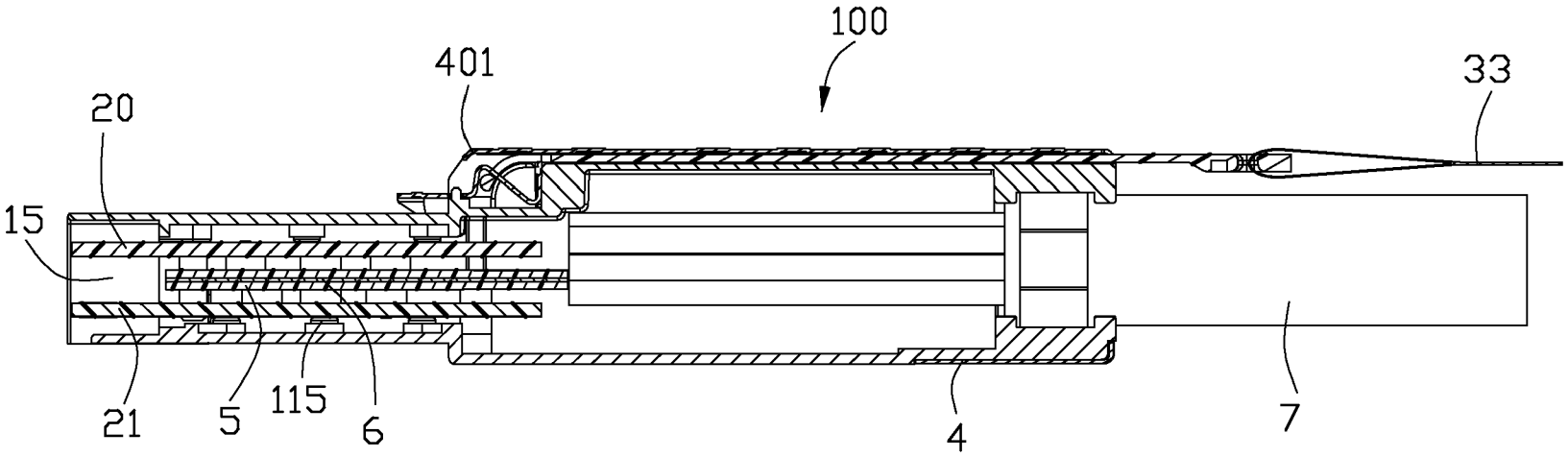
FIG. 6 is a cross-section view taken along line 6-6 of FIG. 5.

Referring to FIGS. 1-2 combination with FIGS. 4-5, the housing 1 of the present invention is made of metal material and comprises a base 11, a cover 12 cooperating with the base 11 to form the receiving cavity 15 and to construct a rear rectangular base portion 13 and an elongated mating portion 14 extending forwardly from the base portion 13.

The base 11 comprises a first base section 11*a* and a first mating section 11*b* extending forwardly from the first base section 11*a*. The first base section 11*a* comprises a first flat main portion 110, a pair of first side walls 117 and a first rear flange 113 respectively extending upwardly from opposite side edges and rear edge of the first flat main portion 110. A notch 1101 is formed in the bottom portion of the first rear flange 113 and penetrates through the bottom surface of the first main portion 110. The front section of the first flat main portion 110 and the first side walls 117 is unitarily thicken by a thicken layer 1102. Rear sections of the first flat main portion 110 and the first side walls 117 are recessed relative to the front section, which is defined as a first coupled section 1103. The first rear flange 113 comprises two rear walls parallel to each other. One rear wall has a pair of first semicircular openings 1130 and the other rear wall has a pair of second semicircular openings 1131 aligned with the first openings 1130 in the front-rear direction.

The first mating section 11*b* comprises a first flat main portion 118 formed with a pair of side walls 114 extending upwards form opposite sides of the first flat main portion 118. Each side wall 114 is formed with a protrusion 116 extending forwardly therefrom. An extension portion 1180 is formed at the front edge of the first flat main portion 118 and extends beyond free ends of the protrusions 116. Two rows of first standoffs 115 are formed on the first flat main portion 118 and arranged adjacent to the respective side walls 114.

The cover 12 comprises a second base section 12*a* and a second mating section 12*b* extending forwardly from the second base section 12*a*. The second base section 12*a* comprises a second flat main portion 120, a pair of second side walls 122 and a second rear flange 123 extending downwardly from opposite side edges and a rear edge of the second flat main portion 120. The front section of the two second side walls 122 of the second base section 12*a* is unitarily thicken by a thicken layer 1220. Rear sections the two second side walls 122 are recessed relative to the front section, which are defined as a second coupled section 1221. The thickness of the front sections of the first base section 11*a* is same to that of the second base section12*a*. The rear flange 123 comprises two rear walls parallel to each other. One rear wall has a pair of third semicircular openings 1230 formed therein and the other rear wall has a pair of forth semicircular openings 1231 aligned with the third opening 1230 in the front-to-rear direction. A pair of recesses 1232 is formed in upper portions of the rear flange 123 and penetrating through the upper surface of the second flat main portion 120.

The upper portion of the second main portion 120 defines a first channel portion 1202 arranged in a middle section thereof and a lower second channel portion 128 in front of the first channel portion 1202. The second channel portion 128 communicates with the first channel portion 1202. A pair of first grooves 1272 is located in the middle section of the main portion 120 and further communicates with the first channel portion 1202. A pair of second grooves 1270 is in front of the first grooves 1272 and also communicates with the first channel portion 1202. A pair of slots 1280 is recessed downwardly from a top surface of a front section of the main portion 120 and communicates with the second channel portion 128. In addition, the second main portion 120 forms a plurality of steps 121 extending therefrom with different heights. A pair of second position holes 1208 is recessed downwardly from the top surface of the second main portion 120 with a certain depth and located at opposite sides of second grooves 1270.

The second mating section 12*b* comprises a second flat base portion 124 with a keyway 1244 formed therein and a pair of L-shaped side walls 125 extending downwardly from opposite sides of the second flat base portion 124. Each side wall 125 comprises a front portion 1250 and a narrower rear portion 1251. A pair of recesses 1252 is formed in rear ends of the front portions 1250 so as to receive the protrusions 116. Two rows of second standoffs 1241 protrudes from the second flat base portion 124.

The pair of PCBs 2 includes a first PCB 20 and a second PCB 21 similar to and beneath the first PCB 20. Two groups of first conductive pads 22 are respectively arranged on a front segment of the PCBs 20, 21 to form the mating interface, and two groups of second conductive pads (not shown) are respectively arranged on the rear segment of the PCBs 20, 21 to form the mounting portion. Each PCB has two through holes 23 formed therein.

An optional latch mechanism 3 is assembled to the shell housing 1 of the cable connector 100. The latch mechanism 3 includes a latch member 31, an actuator 32 and a pull tape 33 attached to a rear portion of the actuator 32. The actuator 32 has a main body 321 received in the first channel portion 1202, a pair of claw-shaped spring members 322 arranged at lateral sides of a front segment of the main body 321 and received in the first grooves 1272, a pair of stopper 323 disposed in front of the spring members 322 and arranged at the lateral sides of the main body 321 and received in the second grooves 1270, an engaging portion 324 formed at the front end of the main body 321 and received in the second channel portion 128. The latch member 31 comprises a latch portion 311 disposed above the second mating section 12*b*, an engaging segment 313 attached to the second base section 12*a*, and a pair of ear portions 3131 interferentially received in the pair of slots 1280 of the second base section 12*a*, an N-shaped interconnecting portion 312 disposed above the engaging portion 324 of the actuator 32.

A conductive shell 4 comprises a frame portion 41 with four walls, an extension portion 40 extending forwardly from an upper wall of the frame portion 41 and abutting against the housing 1, a pair of lateral flanges 400 extending downwardly from opposite sides of the extension portion 40 and a spring portion 401 extending forwardly from the front end of the extension portion 40. The lateral flanges 400 abut against the upper section of the second mating section 1221 above the thicken layer 1220. A pair of first position holes 402 is formed in the front portion of the body portion 40 and located behind the spring portion 401. The frame portion 41 comprises opposite sidewalls 410 connecting with the lateral flanges 400, a pair of position tabs 411 extending downwardly from the rear end of the upper wall of the frame portion 41 and received in the recesses 1232, and a latch portion 412 extending upwardly from the rear end of the bottom wall of the frame portion 41 and received in the notch 1101. The frame portion 41 enclosing the rear portion of the housing 1 abuts against the rear end of the first protrusion portion 1102 of the first flat main portion 110.

A spacer 5 defines an upper surface and an opposite lower surface. Two rows of first protrusion members 51 extend upwardly from the upper surface of the spacer 5. Each row has three protrusion members 51. The rear first protrusion member 51 in the left row and the front first protrusion 51 in the right row respectively has a first cavity 511 therein. Another two rows of second protrusion members 51 extend downwardly from the lower surface. The front second protrusion member 51 in the left row and the rear second protrusion member 51 in the right row respectively has a second cavity 512 therein.

The cable connector assembly 100 further comprises a metal sheet 6 located in the slot of the spacer 5 so as to suppress electro magnetic interference. The metal sheet 6 comprises a base portion 61 and a panel portion 63 extending forwardly from the base portion 61. A plurality of through holes 64 is formed in the panel portion 63. A pair of position tabs 62 extends upwardly and is received in the first cavities 511, and another pair of position tabs 62 extends downwardly and is received in the second cavities 512.

Two cables 7 are located at the same level at a rear wall of the housing and electrically connecting to the mounting portions of the first and second PCBs 2, respectively. Each of the two cables 7 includes a number of wires 70 and an insulated jacket 71 enclosing thereon. A circular-shaped inner ring member 72 is inserted into an interior portion of the insulated jacket 71 of the front portion of the cable 7 to serve as a strain relief. A hexagon-shaped outer ring 73 is crimped to a front portion of the cable 7 and disposed outside of the insulated jacket 71.

When assembly, the wires 70 of one cable 7 are soldered to the conductive pads (not shown) of the second PCB 21, then the second PCB 21 is assembled to the base 11 and supported by the first standoffs 115. Secondly, the spacer 5 is disposed on the second PCB 21, with the pair of position tabs 62 of the metal sheet 6 inserted into the second cavities 512 and the through holes 23 of the second PCB 21. Thirdly, the first PCB 20 is disposed on the spacer 5, with the other pair of position tabs 62 inserted into the first cavities 511 and the through holes 23 of the first PCB 20. Fourthly, the wires 70 of the other cable 7 are soldered to conductive pads (not shown) of the first PCB 20. Fifthly, the cover 12 is assembled to the base 11, with the second standoffs 1241 thereon pressed onto the first PCB 20 so that the first protrusion portion 1102 and the second protrusion 1220 are aligned with each other. Sixthly, the latch mechanism 3 is assembled to the cover 12. Seventhly, the conductive shell 4 is assembled to the cover 12 to fix the latch mechanism 3, with the extension portion 40 and the upper wall of the frame portion 41 of the conductive shell 4 shielding the second base section 12*a*, and the lateral flanges 400 and sidewalls 401 abutting against the first mating section 1103 and the second mating section 1221. The spring portion 401 of the conductive shell 4 presses onto the latch portion 311. With the position tabs received in the recesses and the latch portion received in the notch, the first position holes 402 and the second position holes 1208 align with each other. In this embodiment, the first position holes 402 are though holes and the second position holes 1208 are screw holes. At last, a pair of first bolts 8 penetrates through the position holes 402 and locks with the second position holes 1208 so as to combine the cover 12 and the base 11 together with the conductive shell 4. In another embodiment, the first position holes 402 can be designed as screw hole.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector assembly comprising:

a conductive housing defining a receiving cavity, the receiving cavity including a hollow portion and a mating port located in front of the hollow portion;

a pair of first and second PCBs received in the receiving cavity at different levels, both PCBs having mating interfaces extending into the mating port and mounting portions located within the hollow portion;

at least two cables located at a rear wall of the housing and electrically connecting to the mounting portions of the first and second PCBs, respectively;

a metal shell assembled to the housing and comprising a frame portion, and an extension portion extending forwardly from an upper wall of the frame portion, the frame portion enclosing a rear portion of the conductive housing, the extension portion having a pair of first position holes;

wherein the conductive housing has a pair of second position holes aligned with first position holes respectively, two bolts penetrate through the first position holes and are locked in the second position holes respectively.

2. The cable connector assembly as claimed in claim 1, wherein the first position hole is a through hole, and the second position hole is a screw hole.

3. The cable connector assembly as claimed in claim 1, wherein a spacer is located between the first PCB and the second PCB.

4. The cable connector assembly as claimed in claim 1, wherein the conductive housing comprises a base cooperation with a cover to define the receiving cavity.

5. A cable connector assembly comprising:

a housing comprising a base portion and a mating portion located in front of the base portion intended to be coupled with a complementary connector;

conductive means associated in the housing and exposed to the mating portion intended to connect with the complementary connector;

cables located at a rear end of the base portion and connecting with said conductive means; and a latch mechanism retained on a first face of the base portion of the housing and extending rearwards;

a metal shell comprising a first wall covering the first face of the base portion whereby the latch mechanism is sandwiched between the first wall and the base portion and a frame wall extending from the first wall and fitly enclosing the base portion.

6. The cable connector assembly as claimed in claim 5, wherein the first wall is retained on the first face by bolts and the base portion is depressed at a predetermined position to contain the frame wall to limit a forward movement of the frame wall.

7. The cable connector assembly as claimed in claim 5, wherein the first wall extends to a front end of the base portion and the frame wall is located at a rear end of the base portion.

8. The cable connector assembly as claimed in claim 5, wherein the first wall extends to a front end of the base portion and the frame wall is located at a position to shield connecting joints of the cables connecting with the conductive means.

9. A cable connector assembly comprising:

a housing defining a receiving cavity;

a pair of printed circuit boards received in the receiving cavity in a parallel relation;

a spacer sandwiched between the pair of printed circuit boards;

a pair of cables side by side, in a transverse direction, located behind the printed circuit boards;

a latch mechanism attached upon an exterior face of the housing; and a metallic shell including a frame portion essentially circumferentially enclosing the housing, and an extension portion forwardly extending from a front edge of the frame portion and covering the latch mechanism; wherein the latching mechanism includes a pulling tab which is dimensioned to be larger than a diameter of each of said cables while smaller than a sum of the diameter of each of said cables so as to comply with side by side arrangement of said pair of cables.

* * * * *